US009327176B1

(12) United States Patent
Goserud et al.

(10) Patent No.: US 9,327,176 B1
(45) Date of Patent: May 3, 2016

(54) GOLF PUTTING TRAINING KIT

(71) Applicants: John Thomas Goserud, Landisville, PA (US); Kenneth W. Byers, Clearwater, FL (US)

(72) Inventors: John Thomas Goserud, Landisville, PA (US); Kenneth W. Byers, Clearwater, FL (US)

( * ) Notice: Subject to any disclaimer, the term of this patent is extended or adjusted under 35 U.S.C. 154(b) by 0 days.

(21) Appl. No.: 14/544,712

(22) Filed: Feb. 9, 2015

(51) Int. Cl.
*A63B 69/36* (2006.01)
*A63B 43/00* (2006.01)

(52) U.S. Cl.
CPC ..... *A63B 69/3676* (2013.01); *A63B 43/008* (2013.01); *A63B 2209/08* (2013.01)

(58) Field of Classification Search
CPC .. A63B 57/357; A63B 57/40; A63B 69/3676; A63B 67/02
USPC ..... 473/173, 174, 179, 180, 181, 185–189
See application file for complete search history.

(56) References Cited

U.S. PATENT DOCUMENTS 1,287,903 A * 12/1918 Daily ..... A63B 57/357 473/180
2,236,869 A * 4/1941 Daigle ..... A63B 57/357 473/182
D164,166 S * 8/1951 Griswold ..... 273/127 B
2,933,318 A * 4/1960 Boynton ..... A63B 63/00 473/186
3,494,620 A * 2/1970 Schmudde ..... A63B 57/357 473/180
3,785,656 A * 1/1974 Gybowski ..... A63F 7/305 273/127 D
3,797,833 A * 3/1974 Rokusek ..... A63B 57/357 473/180
4,647,047 A * 3/1987 Little ..... A63B 69/3676 473/187
4,878,671 A * 11/1989 Gubany ..... A63B 67/02 473/172
4,906,006 A * 3/1990 Sigunick ..... A63B 57/357 473/179
4,925,191 A * 5/1990 Ogilvie ..... A63B 57/357 473/189
5,120,063 A * 6/1992 Birchler ..... A63B 57/357 473/180
5,230,511 A * 7/1993 Gubany ..... A63B 57/357 473/196
5,257,808 A * 11/1993 Mueller ..... A63B 69/3623 473/174
D346,831 S * 5/1994 Adams ..... D21/790
5,310,187 A * 5/1994 Yamaguchi ..... A63B 63/00 473/180
D349,321 S * 8/1994 Eversole ..... D21/790
5,766,086 A * 6/1998 Folsom ..... A63B 67/02 473/172
5,997,406 A * 12/1999 Selton ..... A63B 63/007 473/180
6,663,495 B2 * 12/2003 Fun ..... A63B 69/3676 473/180
7,914,387 B1 * 3/2011 Gugliotti ..... A63B 67/02 473/173
2006/0135275 A1 * 6/2006 Kramer ..... A63B 69/3676 473/174
2011/0118041 A1 * 5/2011 Lynch ..... A63B 69/3676 473/180

* cited by examiner

*Primary Examiner* — Mark Graham
(74) *Attorney, Agent, or Firm* — Norman B. Rainer

(57) ABSTRACT

A kit that may be housed in a compact storage container has separate components which interactively produce an assembled golf putting training assembly to be placed upon a substantially flat surface and having a donut shaped receiving ramp, a central aperture that receives a golf ball which rolls over the ramp, and an aiming post.

7 Claims, 2 Drawing Sheets

GOLF PUTTING TRAINING KIT

RELATED APPLICATIONS

This application is based upon Provisional Patent Application Ser. No. 61/965,946, filed Feb. 12, 2014, hereby incorporated herein by reference, and whose filing date is claimed as the filing date of the present Utility Patent Application.

BACKGROUND OF THE INVENTION

1. Field of the Invention

This invention relates to the game of golf, and more particularly concerns apparatus for practicing putting.

2. Description of the Prior Art

In the game of golf, reducing an average score by merely one or two strokes is a significant achievement. Because the vast majority of strokes are spent while putting, many golfers search for ways to improve their putting proficiency in an effort to lower scores. Various putting training devices have heretofore been disclosed, some having moving components, or having bulky size, or being unsteady on smooth floors, or providing unrealistic operational factors.

It is accordingly an object of the present invention to provide a golf putting training apparatus involving no moving components amenable to wear and/or erratic performance.

It is another object of this invention to provide golf putting training apparatus of the aforesaid nature comprised of components which can be packaged in a very small size to facilitate easy storage when traveling or otherwise when not in use.

It is a further object of the present invention to provide apparatus of the aforesaid nature which will resist slipping on a smooth floor when contacted by a golf ball.

It is yet another object of this invention to provide apparatus of the aforesaid nature which closely simulates golf course conditions.

It is a still further object of the present invention to provide apparatus of the aforesaid nature having features which heighten the golfer's cognizance of factors requisite for accurate putting.

These objects and other objects and advantages of the invention will be apparent from the following description.

SUMMARY OF THE INVENTION

The above and other beneficial objects and advantages are accomplished in accordance with the present invention by a kit comprising:

1. An annular ramp component of compliant monolithic structure having a donut shape with concentric interior and exterior circular perimeters spaced apart by about 25 millimeters (mm), said ramp component bounded in part by a slip-resistant flat bottom surface and an upper surface downwardly sloped from said interior perimeter toward said exterior perimeter, said interior perimeter being defined by a circular wall orthogonal to said bottom surface and having a diameter of about 58 mm and height of about 6 mm, causing said ramp component to have, in a radial direction, a uniformly varied thickness between 6 mm at said interior perimeter, and less than about 1 mm at said exterior perimeter, 2. a circular ring component removably emplaceable within said interior perimeter, bounded in part by flat top and lower parallel surfaces and having a centered circular aperture and an outer circular wall having a diameter that is one to two mm smaller than the interior perimeter of said ramp, said ring having a uniform thickness, measured between said top and bottom surfaces, equal to the height of the circular wall of the interior perimeter of said ramp, and 3. a flexible plastic aiming post component elongated between upper and lower extremities, defining a height of 4 to 4.5 inches, and having a uniform thickness between about 1 and 2 millimeters adapted to enable said lower extremity to fit snugly in the space between the interior perimeter of said ramp and the outer wall of said ring component, said upper extremity having a flag-like contour, and said lower extremity having laterally extending structure adapted to be bent to accommodate the circular contour of the interior perimeter of said ramp.

This invention further embraces the assembly formed by the interaction of said components. In a preferred embodiment, said kit further includes a customized golf ball having features which indicate the direction of the putt and perpendicular alignment of the face of a golf club with the direction of the putt.

In a still further embodiment, said ring component may have incorporated therein magnets which enable the ring to have additional value to the golfer in retrieving ferromagnetic golf ball marks as disclosed in U.S. Pat. No. 8,810,345. In such application, the 25 mm diameter of the centered aperture of the ring is of critical importance.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all of the figures of the drawing.

DESCRIPTION OF THE PREFERRED EMBODIMENTS

Figure 1:
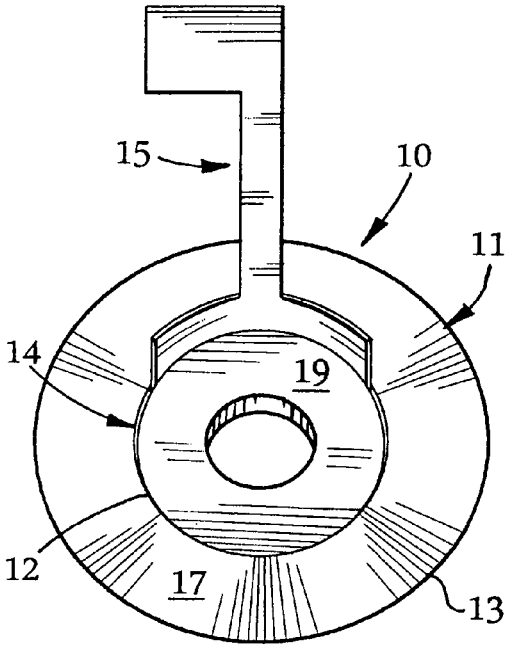
FIG. 1 is a top and front perspective view of an embodiment of the assembled golf putting training kit of the present invention.
Figure 2:
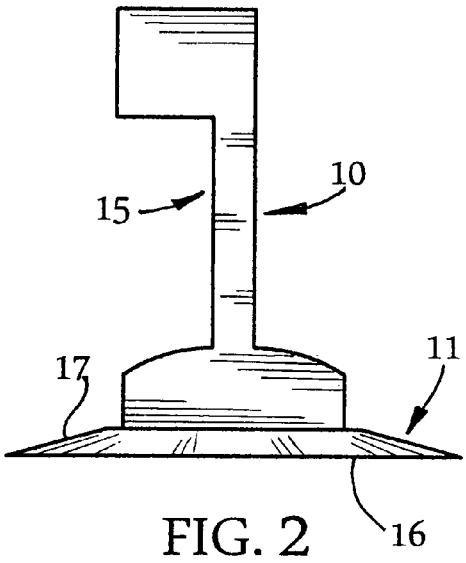
FIG. 2 is a front view of the assembly of FIG. 1.
Figure 3:
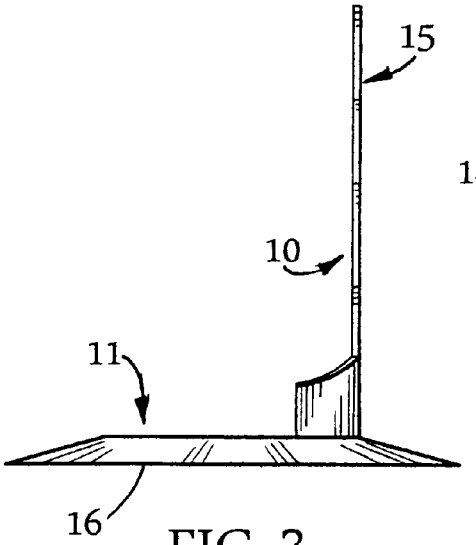
FIG. 3 is a side view thereof.
Figure 4:
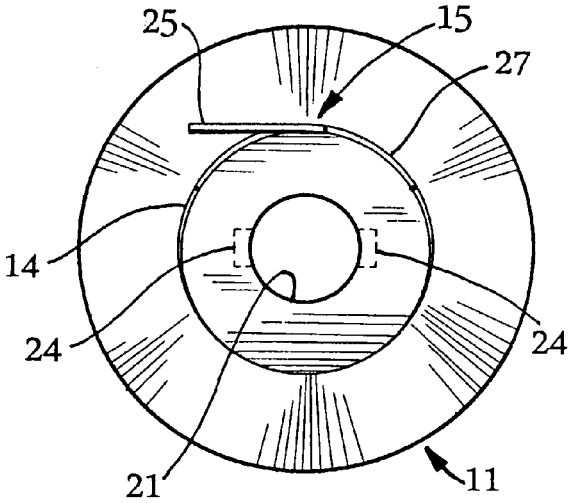
FIG. 4 is a top view thereof.
Figure 5:
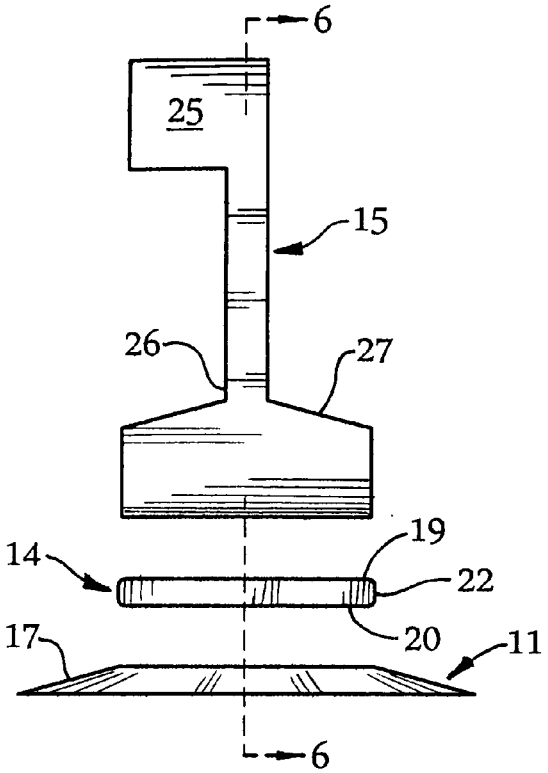
FIG. 5 is an exploded front view of the assembly as shown in FIG. 2.

Referring now to FIGS. 1-6, an embodiment of the golf putting training kit of this invention is shown and described in terms of its separate components and assembled apparatus.

The assembly 10 is comprised of: (a) a donut-shaped annular ramp component 11 having concentric interior and exterior circular perimeters 12 and 13 respectively, (b) circular ring component 14 removably emplaced within said interior perimeter, and (c) aiming post 15 frictionally held between ring component 14 and interior perimeter 12 of said ramp component.

Figure 6:
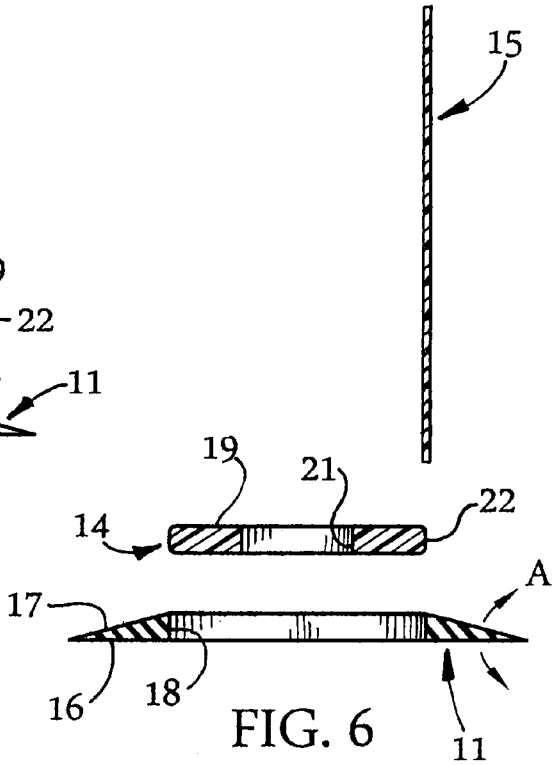
FIG. 6 is a sectional view taken in the direction of the arrows upon line 6-6 of FIG. 5.
Figure 7:
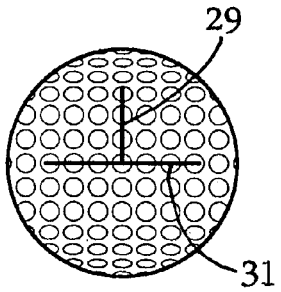
FIG. 7 is a top view of a golf ball customized for use as a component of the kit of the present invention.

Ramp component 11 is preferably a monolithic structure fabricated of a compliant plastic, and wherein the diameter of said interior perimeter is about 58 millimeters (mm), and the diameter of said exterior perimeter is about 103 mm, which is the standard diameter of a regulation golf hole. Said ramp component is bounded in part by flat bottom surface 16, and upper surface 17 downwardly sloped from interior perimeter 12 toward exterior perimeter 13. The slope angle, shown as angle A in FIG. 6 is 12+/−2 degrees. Interior perimeter 12 is defined by circular wall 18 orthogonal to bottom surface 16, and having a height of about 6 mm. Such dimensional configuration causes ramp component 11 to have, in a radial direction, a uniformly varied thickness between 6 mm at interior perimeter 12, and less than about 1 mm at exterior perimeter 13. Suitable compliant plastics include silicone and other soft polymers having Shore Durometer Hardness in the range of 65 to 85. Such compliant plastics cause bottom surface 16 to engage an underlying surface in a manner to produce resistance to slipping.

Ring component 14 is bounded in part by parallel flat top and bottom hard surfaces 19 and 20, respectively, defining centered circular aperture 21 which is intended to seat a golf ball. Said ring component is further bounded by outer circular wall 22 having a diameter that is one to two mm smaller than interior perimeter 12 of ramp component 11, thereby enabling said ring component to be easily seated within said perimeter 12. The thickness of ring component 14, measured between said top and bottom surfaces, is equal to the height of circular wall 18 of said ramp component. In a preferred embodiment, small permanent magnets 24 may be located within said ring component in diametrically opposed positions. In such embodiment, and wherein the diameter of aperture 21 is 25 mm, the ring component serves the further purpose for the golfer of securing ferromagnetic golf ball marks, as described in U.S. Pat. No. 8,810,345.

Aiming post 15 is an integral piece of bendable thin plastic of about 1 mm thickness, and extending a length of about 105 mm between an upper extremity 25 having a flag-like contour and a lower extremity 26. Laterally extending shoulders 27 emergent from extremity 26 serve to provide secure seating of the aiming post in the curved space between the outer circular wall 22 of ring component 14 and the circular wall 18 of ramp component 11. Shoulders 27 further serve as a backstop to prevent over ride of golf balls which might tend to travel past aperture 21.

Figure 8:
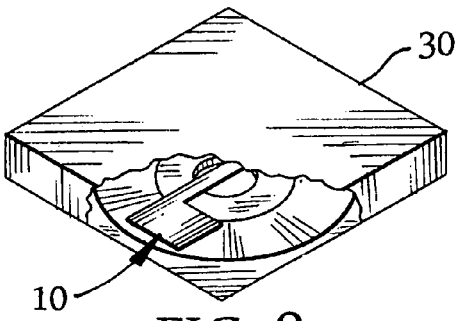
FIG. 8 is a top perspective view of a merchandising package containing the kit of the present invention, portions being broken away to show interior details.

Because of their specialized configurations and above-noted dimensions, the components of assembly 10 can be confined within a small merchandising box 30 as shown in FIG. 8 measuring about 110 mm square with a thickness of about 9 mm, thereby facilitating storage for travel or office or in-pocket carry.

In use, ramp component 11 is placed on a reasonably flat surface. The ring and post components are then emplaced. Because of the combined effects of the slip-resistant bottom surface and critical slope angle of the ramp component, the assembly will resist slipping displacement when a golf ball is caused to roll onto said ramp component and into seated engagement upon aperture 21 of said ring component. This advantageous feature facilitates use on floor surfaces which may have imperceptible or designed irregularities or coatings of wax or dust-like debris. A beginning user of the kit of this invention has the option of employing the ramp component alone, without the ring component, thereby presenting a larger target.

In a further embodiment of the kit of the present invention, there may be provided, in addition to the components for assembly 10, a customized golf ball as shown in FIG. 8 having a direction-pointing line 29 perpendicular to an alignment line 31 which may be a simple line or a line of lettering, forming a meaningful word or words. In practicing his putting accuracy, the golfer will use line 29 to point toward the target, namely aperature 21 of the ring component. At the same time, he causes the face of his golf club to be parallel with alignment line 31. It is only when such aiming and alignment factors are observed that an accurate putt can be made.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A kit for golf putting training comprising:

a) an annular ramp component of compliant structure having a donut shape with concentric interior and exterior circular perimeters and bounded in part by a slip resistant flat bottom surface and an upper surface downwardly sloped from said interior perimeter toward said exterior perimeter, said interior perimeter being defined by a circular wall substantially orthogonal to said bottom surface and having a height of about 6 mm, causing said ramp component to have, in a radial direction, a uniformly varied thickness between about 6 mm at said interior perimeter, and less than about 1 mm at said exterior perimeter, b) a circular ring component removably emplaceable within said interior perimeter, bounded in part by top and lower surfaces and having a centered circular aperture and an outer circular wall having a diameter one to two mm smaller than the diameter of the interior perimeter of said ramp component, and c) a flexible plastic aiming post component elongated between upper and lower extremities, having a uniform thickness between about 1 and 2 millimeters adapted to enable said lower extremity to fit snugly in the space between the interior perimeter of said ramp component and the outer wall of said ring component, said upper extremity having a flag-like contour, and said lower extremity having laterally extending structure adapted to be bent to accommodate the circular curvature of the interior perimeter of said ramp component.

2. An assembly formed by the interaction of the components of the kit of claim 1.

3. The kit of claim 1 further comprising a customized golf ball having features which indicate the direction of the intended putt and the proper perpendicular alignment of the face of a golf club with said direction of the putt.

4. The kit of claim 1 wherein the diameter of the centered aperture of said ring component is about 25 mm, and a pair of permanent magnets are confined within said ring component in diametric opposition adjacent said aperture, thereby enabling said ring component to provide the additional functionality for a golfer in retrieving ferromagnetic golf ball markers.

5. The kit of claim 1 housed within a merchandising package measuring about 110 mm square and having a thickness of about 9 mm.

6. The kit of claim 1 wherein said compliant structure of said ramp component has a Shore Durometer Hardness between 65 and 85.

7. The kit of claim 6 wherein the upper and bottom surfaces of said ramp component meet at said exterior perimeter at an angle of between 11° and 13°.

* * * * *